United States Patent [19]

Evensen

[11] Patent Number: 5,067,291

[45] Date of Patent: Nov. 26, 1991

[54] PASS-THROUGH ROOF SEAL SYSTEM

[76] Inventor: Laurence P. Evensen, 7711 Millwood Ave., Canoga Park, Calif. 91304

[21] Appl. No.: 534,989

[22] Filed: Jun. 8, 1990

[51] Int. Cl.[5] ..... E04D 13/14

[52] U.S. Cl. ..... 52/219; 52/199; 52/218; 285/42

[58] Field of Search ..... 52/219, 218, 198, 199; 285/42, 43, 44

[56] References Cited

U.S. PATENT DOCUMENTS

| | | | |
|---|---|---|---|
| 917,167 | 4/1909 | Shaw | 285/43 |
| 1,103,666 | 7/1914 | Fife | 285/44 |
| 2,372,707 | 4/1945 | Blome | 52/218 |
| 3,708,185 | 1/1973 | Bilicki et al. . | |
| 3,871,145 | 3/1975 | Hatmaker . | |
| 4,102,090 | 7/1978 | Anguish . | |
| 4,211,423 | 7/1980 | Resech . | |
| 4,280,305 | 7/1981 | Logsdon . | |
| 4,433,860 | 2/1984 | Linquist . | |

*Primary Examiner*—Michael Safavi

*Attorney, Agent, or Firm*—John J. Posta, Jr.

[57] ABSTRACT

The pass-through roof pipe seal system includes an adapter in the form of an inverted funnel with a vertical upper tube and integral lower flared skirt defining a central cavity through which a coolant pipe from a roof air-conditioning unit or the like passes. The pipe has an external layer of insulation around it except for a cut-away portion in the area of the funnel tube, which tube adheres directly and sealingly to the coolant pipe itself to prevent moisture from penetrating the system. The funnel skirt flares out over the lower edge of the cut-away portion of the invention and thus protects it from moisture and also overlies an inverted funnel-shaped vent cup having an upper vertical tube and lower skirt. The vent cup tube is adhered to the outside of the insulation layer around the coolant pipe below the adapter and is protected by the adapter skirt. The vent cup overlies the roof hole of a building upon which an air-conditioning unit is installed and prevents moisture from entering the building. The system is simple, durable and efficient.

5 Claims, 1 Drawing Sheet

PASS-THROUGH ROOF SEAL SYSTEM

BACKGROUND OF THE INVENTION

1. Field of the Invention

The present invention generally relates to seals and more particularly to an improved roof pipe sealing system.

2. Prior Art

Air-conditioning units for buildings are frequently placed on the roof, with coolant pipes passing through the roof to and from the air-conditioning units. Many types of roof pipe seals have been devised for this and other similar situations. See, for example, U.S. Pat. Nos. 4,280,305 for roof flashing for solar collectors, U.S. Pat. No. 4,211,423 for a generally conical flashing unit and U.S. Pat. No. 3,871,145 for flashing for a pitch pocket. Most commonly used is an inverted funnel-shaped vent cup, the upper tube portion of which is adhesively connected to the outside of the insulation layer around a coolant pipe or the like. The problem with such a device is breaking of the moisture seal with the insulation layer as the insulation and/or adhesive deteriorates due to weathering. Once this seal is broken, moisture can penetrate the insulation and run down the exterior of the pipe, through the roof hole which is covered by the vent cup and into the building, ruining the interior of the building. There remains a need for a simple, durable and inexpensive system to overcome this problem and thus prevent moisture penetration through roof pipe holes.

SUMMARY OF THE INVENTION

The improved pass-through roof pipe seal system of the present invention satisfies all the foregoing needs. The system is substantially as set forth in the Abstract of the Disclosure. Thus, it includes an upper adapter in the form of an inverted funnel with an upper vertical tube and an integral lower flared skirt defining a central cavity through which a coolant pipe passes from a roof air-conditioning unit or the like. The pipe has an external layer of insulation around it except in a cut-away portion in the area of the adapter funnel tube, which tube is permanently bonded directly to the pipe to prevent moisture from penetrating the system.

The funnel flares out to overlie the lower edge of the cut-away portion of pipe insulation and thus protects it from moisture penetration. It also overlies an inverted funnel-shaped vent cup having an upper cup tube and a lower flared cup skirt. The cup tube is bonded to the exterior of the insulation layer around the coolant pipe below the adapter and is protected by the adapter skirt.

The vent cup overlies the roof of a building upon which an air-conditioning unit employing the pipe is installed and prevents moisture from entering through a pipe hole in the roof which the cup covers. The system is simple, durable and inexpensive, as well as being efficient in preventing passage of moisture into the building upon which it is mounted. Further advantages of the system are set forth in the following detailed description and accompanying drawings.

DRAWINGS

DETAILED DESCRIPTION

FIG. 1

Figure 1:
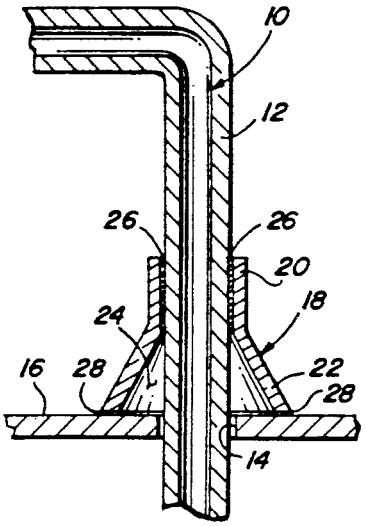
FIG. 1 (PRIOR ART)
FIG. 1 is a schematic vertical cross-section of a conventional prior art roof pipe seal vent cup in place on a roof.

Referring more particularly to FIG. 1 of the drawings, a prior art vent cup for an air-conditioning roof pipe is shown in sealing engagement with the insulated layer around the pipe and positioned to cover a roof pipe hole.

Thus, an air-conditioning unit roof pipe 10 is shown which has an insulated external layer 12 therearound. Pipe 10 extends vertically down through an opening 14 in roof 16 into a building (not shown) covered by roof 16. An inverted funnel-shaped vent cup 18 comprises an upper narrow tubular portion 20 and a lower depending integral skirt 22 defining therewith a central space 24. Portion 20 is sealed, as by adhesive layer 26, directly to the outside of insulative layer 12 and the bottom of skirt 22 may be sealed, as by an adhesive layer 28 to roof 16. When layer 12 or 26 breaks down due to weathering where adhesive layer 26 is applied to layer 12, moisture can penetrate into space 24 and migrate freely through hole 14 into the building coverfed by roof 16, defeating the purpose of vent cup 18, and causing damage to the interior of such building.

Figure 2:
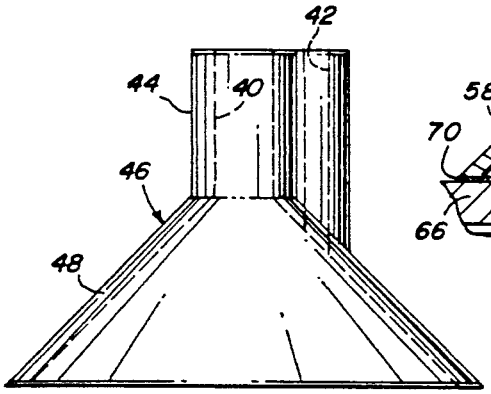
FIG. 2 is a schematic side elevation of a preferred embodiment of the roof seal adapter of the present system.
Figure 4:
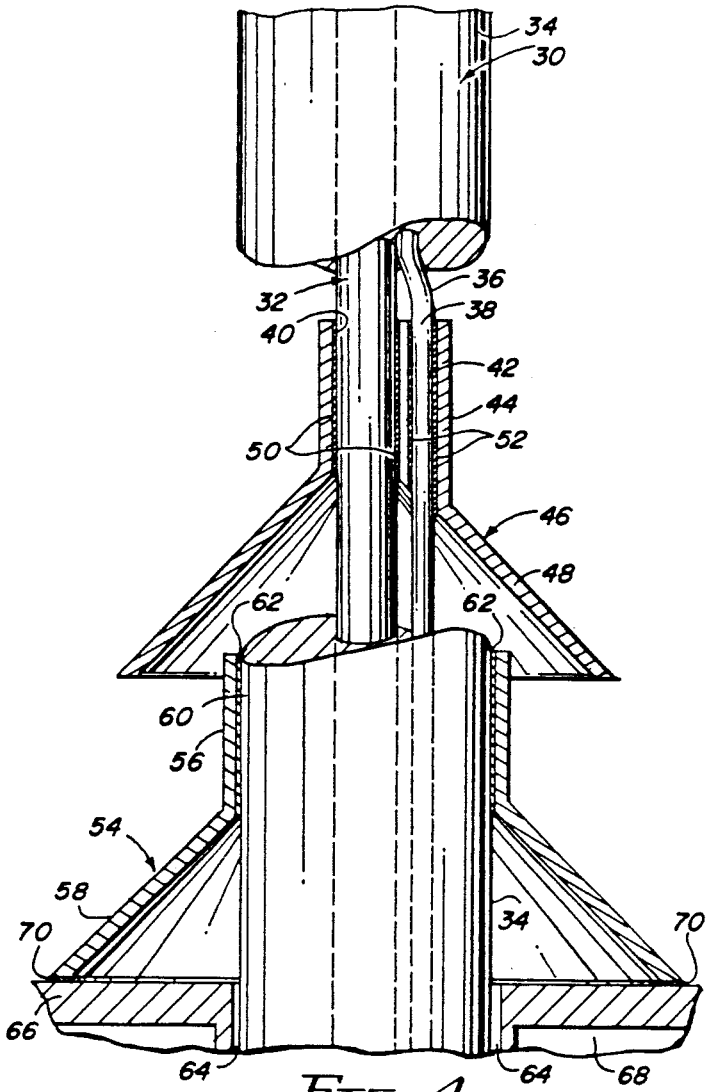
FIG. 4 is a schematic side elevation, partly in section, of a preferred embodiment of the present system, employing the adapter of FIGS. 2 & 3, along with a vent cup.
Figure 3:
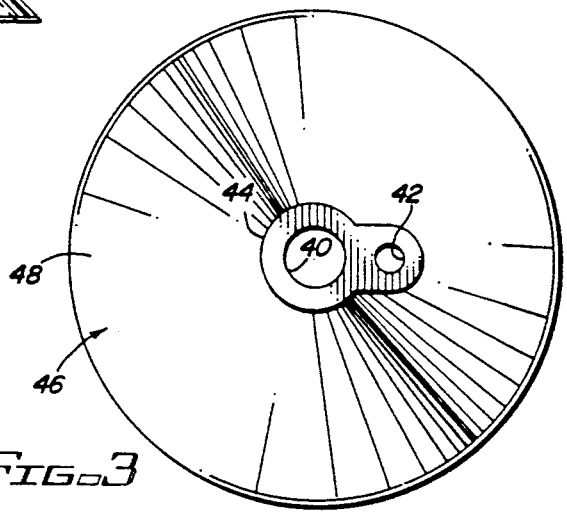
FIG. 3 is a schematic top plan view of the adapter of FIG. 2.

FIGS. 2, 3 and 4

The improved system of FIGS. 2, 3 & 4 prevents moisture from penetrating through the roof of a building upon which the system is mounted. Thus, system 30 (FIG. 4) is shown which comprises a coolant roof pipe or other roof pipe 32 bearing an external insulated layer 34, except in a cut-away portion 36. In system 30, a second smaller return pipe 38 may be disposed also within insulated layer 34. Pipes 32 and 38 pass vertically down through openings 40 & 42 (FIGS. 3 & 4) in the upper tubular portion 44 of adapter 46 which is in the form of an inverted funnel, having an integral lower flared skirt 48. It will be noted that tube 44 is directly and permanently sealed against moisture to pipes 32 and 38, as by adhesive layers 50 & 52, respectively. Adapter 46 may be split into two equal hinged halves together, or two integral halves, soldered or otherwise secured in place around pipes 32 and 38 (FIG. 3).

Skirt 48 overlies and moisture protects the lower edge of cut-away portion 36 against ingress of moisture. Below that cut-away portion 36, an inverted funnel-shaped vent cup 54 is provided having an upper vertical tube 56 and integral lower flared skirt 58. Tube 56 may be split into two equal hinged or unhinged halves, subsequently soldered or otherwise secured around pipes 32 & 38. Tube 56 has a central opening 60 down through which pipes 32 & 38 fully insulated with layer 34 pass, being sealed thereto by adhesive layer 62 against layer 34. Pipes 32 & 38 pass down through an opening 62 in roof 64 into a roofed building 66.

The lower end of skirt 58 may be sealed, as by adhesive layer 70, directly to roof 66, or otherwise attached thereto (e.g., nails, not shown). Skirt 48 protects system 30 against moisture penetration if adhesive layer 62 separates from insulated layer 34 in tube 56, because skirt 48 physically overlies or covers this part of system 30. Accordingly, system 30 remains moisture proof and prevents moisture from passing into building 68 through opening 64.

One or more of pipes 32 & 38, adapter 46 and vent cup 54 may be metal, plastic, rubber, ceramic, etc., or mixtures thereof, as desired, for durability and functionality. It will be understood that adapter 46 and vent cup 54 can be any suitable size and proportions.

Various other modifications, changes, alterations and additions can be made in the improved system of the present invention, its components and parameters. All such modifications, changes, alterations and additions as are within the scope of the appended claims form part of the present invention.

What is claimed is:

1. An improved pass-through roof pipe seal system, said system comprising, in combination:

a) an adapter comprising an inverted funnel having an upstanding vertical upper tube and an integral lower skirt flaring downwardly and outwardly therefrom, said tube and skirt defining a central cavity;

b) an air-conditioning coolant pipe assembly comprising an external, flexible insulated jacket disposed around a pipe, said assembly including a vertical pipe portion from which said jacket has ben cut-away to form a cut-away pipe portion, which pipe portion passes down through said adapter cavity and wherein said pipe is directly sealed to said tube, said skirt covering the lower edge of said cut-away pipe portion for maximum moisture protection;

c) an inverted funnel-shaped vent cup having an upper vertical tube and lower skirt, said cup being secured directly to the outside of said jacket below said adapter, such that said cup is displaced from said coolant pipe by said insulated jacket; and d) wherein said adapter funnel tube has a pair of spaced vertical openings parallel to each other and extending down to said skirt, wherein said coolant pipe assembly includes a return pipe parallel to said coolant pipe, and wherein said pipes are disposed in and sealed directly to said openings in said tube.

2. The improved system of claim 1 wherein said vent cup tube is below said adapter skirt.

3. An adapter for preventing moisture from passing through a roof having an opening therein and having a pipe with insulation thereon pass through said opening, and also having a vent cup which includes a vertical tube disposed about said pipe and insulation and secured to said insulation, comprising, a) an inverted funnel portion having an upper vertical tube section and a lower downwardly and outwardly extending skirt portion, b) said tube section having an opening therein with an inner diameter which is substantially identical to the outside diameter of said pipe, c) wherein said tube section is secured directly to said pipe, d) wherein said roof has an opening therein adapted to have a plurality of pipes with insulation thereon pass therethrough, e) wherein said tube section has a plurality of openings therein which have inner diameters corresponding, respectively, to substantially the outside diameters of said plurality of pipes, and f) wherein said tube section is secured directly to said plurality of pipes.

4. The adapted of claim 3 which is comprised of two substantially equal unhinged parts adapted to be mated and secured together.

5. The adapter of claim 3 which is comprised of two substantially equal hinged parts adapted to be mated and secured together.

* * * * *